US008076265B2

(12) United States Patent
Suzuki et al.

(10) Patent No.: US 8,076,265 B2
(45) Date of Patent: Dec. 13, 2011

(54) THERMAL TRANSFER IMAGE-RECEIVING SHEET

(75) Inventors: Masamitsu Suzuki, Tokyo (JP); Shinji Kometani, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 755 days.

(21) Appl. No.: 11/908,995

(22) PCT Filed: Mar. 20, 2006

(86) PCT No.: PCT/JP2006/305586
§ 371 (c)(1),
(2), (4) Date: Sep. 18, 2008

(87) PCT Pub. No.: WO2006/098474
PCT Pub. Date: Sep. 21, 2006

(65) Prior Publication Data

US 2009/0022911 A1 Jan. 22, 2009

(30) Foreign Application Priority Data

Mar. 18, 2005 (JP) ..... 2005-080545

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS

| | | | |
|---|---|---|---|
| 5,225,392 | A | 7/1993 | Chang et al. |
| 6,107,245 | A | 8/2000 | Kuga et al. |
| 6,476,083 | B1 | 11/2002 | Okura et al. |

FOREIGN PATENT DOCUMENTS

| | | |
|---|---|---|
| EP | 0775590 | 5/1997 |
| EP | 0775943 | 5/1997 |
| EP | 1221381 | 7/2002 |
| JP | 6-297866 A | 10/1994 |
| JP | 07-101163 | 4/1995 |
| JP | 09-175048 | 7/1997 |
| JP | 09-175052 | 7/1997 |
| JP | 10-044628 | 2/1998 |
| JP | 2002-192841 | 7/2002 |

OTHER PUBLICATIONS

Mar. 29, 2011 Office Action issued in related Japanese Application No. 2006-077527, with its English language translation. Office Action issued in related Japanese Application No. 2006-077527, with its English language translation.

*Primary Examiner* — Bruce H Hess
(74) *Attorney, Agent, or Firm* — Connolly Bove Lodge & Hutz LLP

(57) ABSTRACT

It is an object of the present invention to provide a thermal transfer image-receiving sheet which solves the defects of the prior art, that is, exhibits a good slipping property between the thermal transfer image-receiving sheets in forming images and can completely prevent feeding troubles such as multi feeding particularly in a thermal transfer printer in a low temperature environment.

The present invention pertains to a thermal transfer image-receiving sheet in which a receiving layer is formed on at least one side of a substrate sheet, wherein the receiving layer is formed by applying and drying a coating solution comprising a binder resin, a release agent, and a lubricant in an amount of 0.05 to 5 parts by weight with respect to 100 parts by weight of the binder resin and said lubricant is a main-chain single-end or a main-chain dual-end modified silicone oil having a viscosity of 50 to 500 $mm^2/s$ at 25° C.

4 Claims, 1 Drawing Sheet

THERMAL TRANSFER IMAGE-RECEIVING SHEET

RELATED APPLICATIONS

This application is a national stage application (under 35 U.S.C. §371) of PCT/JP2006/305586 filed Mar. 20, 2006, which claims benefit of Japanese application 2005-080545 filed Mar. 18, 2005, disclosure of which are incorporated herein by reference.

TECHNICAL FIELD

The present invention relates to a thermal transfer image-receiving sheet which exhibits a good slipping property between the thermal transfer image-receiving sheets in forming images and can completely prevent feeding troubles such as multi feeding particularly in a thermal transfer printer in a low temperature environment.

BACKGROUND ART

Hitherto, various thermal transfer methods have been publicly known, and among these methods, a method, in which a sublimation dye is used as a recording material and it is supported on a substrate sheet of paper, a plastic film or the like to form a thermal transfer sheet, and various full color images are formed on a thermal transfer image-receiving sheet which can be dyed with a sublimation dye, for example, a thermal transfer image-receiving sheet in which a dye receiving layer is provided on the surface of paper, a plastic film or the like, is proposed. This method can adjust density tones freely since it uses the sublimation dye as a color material, and can express full color images of documents. Further, since its images formed by a dye has high sharpness and excellent transparency, this method has excellent neutral tint reproducibility and excellent tone reproducibility and can form high quality images compatible with silver halide photography.

In a thermal transfer printer of a system in which an image-receiving sheet cut out into a prescribed size in advance as a thermal transfer image-receiving sheet is loaded to be printed, if a coefficient of friction between a receiving layer and a backside layer (between the image-receiving sheets) is high, this causes feeding troubles such as multi feed in the printer. Further, such feeding troubles are phenomena which particularly tends to occur in a low temperature environment. On the other hand, for example in Patent Document 1, a thermal transfer image-receiving sheet formed by providing a receiving layer on one side of a substrate sheet and providing a slipping backside layer on the other side of the substrate sheet, characterized in that the slipping backside layer is predominantly composed of a fixing agent and a nylon filler is shown and it is described that the surface of the slipping backside layer of the image-receiving sheet comes to have fine projections and depressions, paper feeding/discharging properties in a printer are excellent, and if the thermal transfer image-receiving sheet is preserved with the backside overlaying on the print surface, there is no set off. However, in the conventional thermal transfer image-receiving sheet described above, it is in a status in which a printer capable of solving the feeding troubles such as multi feed particularly in the printer in a low temperature environment completely is not yet found.

Patent Document 1: Japanese Kokai Publication Hei-7-101163

DISCLOSURE OF THE INVENTION

Problems to be Solved by the Invention

It is an object of the present invention to provide a thermal transfer image-receiving sheet which solves the defects of the prior art, that is, exhibits a good slipping property between the thermal transfer image-receiving sheets in forming images and can completely prevent feeding troubles such as multi feeding particularly in a thermal transfer printer in a low temperature environment.

Means for Solving the Problems

The present invention pertains to as claim 1 a thermal transfer image-receiving sheet in which a receiving layer is formed on at least one side of a substrate sheet, wherein the receiving layer is formed by applying and drying a coating solution comprising a binder resin, a release agent, and a lubricant in an amount of 0.05 to 5 parts by weight with respect to 100 parts by weight of the binder resin and said lubricant is a main-chain single-end or a main-chain dual-end modified silicone oil having a viscosity of 50 to 500 $mm^2/s$ at 25° C. Further, the present invention pertains to as claim 2 the release agent comprises a side-chain epoxy modified silicone oil. In addition, the present invention pertains to as claim 3 the receiving layer according to claim 1 or 2 further comprises a curing agent.

Effects of the Invention

In the constitution in which a receiving layer is formed on at least one side of the substrate sheet, the thermal transfer image-receiving sheet of the present invention in which the receiving layer is formed by applying and drying a coating solution comprising a binder resin (1), a release agent (2), and a lubricant (3) in an amount of 0.05 to 5 parts by weight with respect to 100 parts by weight of the binder resin (1) and the lubricant (3) is a main-chain single-end or a main-chain dual-end modified silicone oil having a viscosity of 50 to 500 $mm^2/s$ at 25° C. By containing the main-chain single-end or main-chain dual-end modified silicone oil having the viscosity of a prescribed range in a specified range with respect to the binder resin as described above, a thermal transfer image-receiving sheet, which is good at a feeding property in the thermal transfer printer and is good at a feeding property particularly in a low temperature environment, is obtained.

BEST MODE FOR CARRYING OUT THE INVENTION

An embodiment of a thermal transfer image-receiving sheet of the present invention is shown in FIG. 1. A thermal transfer image-receiving sheet 1 shown in drawings has a constitution in which a receiving layer 3 is formed on one side of a substrate sheet 2 and a backside layer 4 is formed on the other side of the substrate sheet 2. The thermal transfer image-receiving sheet of the present invention is not limited to layers shown in drawings, and layers such as an antistatic layer, a cushion layer, an intermediate layer to which a white pigment and a fluorescent brightener are added and a easy-adhesive layer may be formed between the substrate sheet and the receiving layer as required. Further, layers such as an antistatic layer, a writing layer and a backside layer may be formed on the side opposite to the side of the substrate sheet on which the receiving layer is formed.

Next, the respective layers constituting the thermal transfer image-receiving sheet obtained in the present invention will be described below.

(Substrate Sheet)

The substrate sheet 2 has a role of holding the receiving layer, and desirably withstands the heat added during forming images and has mechanical properties of the level of not interfering with handling.

A material of such a substrate sheet is not particularly limited, and as the material, for example, various plastic films or sheets such as polyester, polyarylate, polycarbonate, polyurethane, polyimide, polyetherimide, cellulose derivatives, polyethylene, ethylene-vinyl acetate copolymer, polypropylene, polystyrene, acryl, polyvinyl chloride, polyvinylidene chloride, polyvinyl alcohol, polyvinyl butyral, nylon, polyetheretherketone, polysulfone, polyethersulfone, tetrafluoroethylene-perfluoroalkylvinylether copolymer, polyvinyl fluoride, tetrafluoroethylene-ethylene copolymer, tetrafluoroethylene-hexafluoropropylene copolymer, polychlorotrifluoroethylene and polyvinylidene fluoride can be used, and are not limited.

A white film obtained by adding a white pigment or a filler to the plastic films or sheets described above or synthetic resins thereof and forming them into a film, or a sheet having micro-voids within the substrate sheet, or in addition capacitor paper, glassine paper, parchment paper, synthetic paper (polyolefin, polystyrene), bond paper, art paper, coated paper, cast coated paper, synthetic resin or emulsion-impregnated paper, synthetic rubber latex-impregnated paper, synthetic resin added paper, cellulose fiber paper and the like can be used. In addition, a laminated body based on the arbitrary combination of the substrate sheets described above can also be used. Typical examples of the laminated body include laminated bodies of cellulose fiber paper and synthetic paper, and cellulose fiber paper and a plastic film.

Also, a substrate sheet obtained by applying a treatment for easy-adhesion to the surface and/or the backside of the substrate sheet can also be used. The thickness of these substrate sheets is generally about 3 to 300 μm, and in the present invention, a substrate sheet of 75 to 175 μm is preferably used in consideration of mechanical suitability. Further, when the adhesion of the substrate sheet to a layer provided thereon is low, it is preferred to apply a treatment for easy-adhesion or a corona discharge treatment to the surface of the substrate sheet.

(Receiving Layer)

The receiving layer 3 in the present invention is a receiving layer which contains one or more species of thermoplastic resins on at least one side of the substrate sheet and is provided for the purpose of receiving a sublimation dye transferred from the thermal transfer sheet and maintaining the formed thermal transfer images. The binder resin (1) used for the receiving layer is a thermoplastic resin, and examples of the thermoplastic resin include halogenated polymers such as polyvinyl chloride and polyvinylidene chloride; vinyl resins such as polyvinyl acetate, ethylene-vinyl acetate copolymer, vinyl chloride-vinyl acetate copolymer, polyacrylic ester, polystyrene and polystyrene-acryl; acetal resins such as polyvinyl formal, polyvinyl butyral and polyvinyl acetal; saturated or unsaturated various polyester resins; polycarbonate resins; cellulose resins such as cellulose acetate; polyolefin resins; polyamide resins; and the like. These resins can be used alone or as a mixture formed by freely blending within the bounds of being compatible with each other.

Further, as the thermoplastic resin, a thermoplastic resin having active hydrogen can be employed. As the active hydrogen, hydrogen existing at the end of the thermoplastic resin can be selected in consideration of the stability of each thermoplastic resin.

When this thermoplastic resin having active hydrogen is used as the binder resin (1), and used in combination with a curing agent, since the active hydrogen reacts with the curing agent, it is possible to cure the binder resin (1) by crosslinking and improve the heat resistance of the receiving layer. The curing agent can also reacts with modified silicone described below in detail to fix the release agent in the receiving layer and prevent the release agent from transferring from the receiving layer to the backside in contact with the receiving layer.

As the curing agent, isocyanate, chelate compounds or the like can be used. Among those, un-yellowing isocyanate compounds are preferably used. Specific examples of the isocyanate compounds include xylene diisocyanate (XDI), hydrogenated XDI, isophorone diisocyanate (IPDI), hexamethylene diisocyanate (HDI), and adducts/biurets, oligomers and prepolymers thereof, and the like. In addition to these, un-yellowing isocyanate compounds of isocyanate compounds which initiate a reaction within such a time that a solvent of the coating solution for a receiving layer is evaporated can be used as a curing agent.

The curing agent is generally used in an amount about 0.1 to 4 parts by weight, preferably about 0.5 to 1.5 parts by weight, with respect to 100 parts by weight of the binder resin (1). When the amount of the curing agent is too small, a curing reaction by crosslinking may become insufficient and the improvement in heat resistance of the receiving layer may be insufficient. When the amount of the curing agent is too large, a ratio of the release agent is decreased, and therefore fusion to a dye binder may tends to occur during printing.

A catalyst may be added as a reaction aid of the isocyanate compound, and any publicly known catalyst may be used.

Examples of typical catalyst include di-n-butyltin dilaurate (DBTDL) of a tin catalyst. In addition to this, dibutyltin fatty acid salt catalysts, monobutyltin fatty acid salt catalysts, dioctyltin fatty acid salt catalysts, monooctyltin fatty acid salt catalysts, and dimmers thereof are effective. Since the tin catalyst has a larger reaction rate as an amount of tin per catalyst mass increases, it is better to select species, combinations and addition rate of the tin catalyst in accordance with the isocyanate compounds to be used.

Further, when a blocked type isocyanate compound is used, concurrent use of a blocked dissociation catalyst is effective.

In the thermal transfer image-receiving sheet of the present invention, the receiving layer is formed from a coating solution comprising the binder resin (1), the release agent (2), the lubricant in an amount of 0.05 to 5 parts by weight with respect to 100 parts by weight of the binder resin (1), and the lubricant (3) is a main-chain single-end or a main-chain dual-end modified silicone oil having a viscosity of 50 to 500 $mm^2/s$ at 25° C.

The viscosity was measured according to JIS K 2283-2000 Crude petroleum and petroleum products—Determination of kinematic viscosity and calculation of viscosity index from kinematic viscosity, and it was measured in the conditions that both samples and a measuring environment are 25° C.

When the viscosity is too high, the slipping property is insufficient and feeding troubles such as multi feeding tends to occur particularly in a thermal transfer printer in a low temperature environment, and when the viscosity is too low, the feeding property in a thermal transfer printer is not good.

When the proportion of the added lubricant (3), which has a viscosity of 50 to 500 $mm^2/s$ at 25° C. and is a main-chain single-end or a main-chain dual-end modified silicone oil, to be added is less than the above range, the slipping property is insufficient and feeding troubles such as multi feeding tends to occur particularly in a thermal transfer printer in a low temperature environment, and on the other hand, when the proportion is more than the above range, the adverse effects that a property receiving a dye is deteriorated and an adequate recording density is not obtained tends to occur.

Examples of the lubricant (3) of the main-chain single-end or the main-chain dual-end modified silicone oil include silicone oils, which have modified groups described below at the main-chain single-end or the main-chain dual-end in each chemical structure, such as a polyether modified silicone oil, a phenol modified silicone oil, an alcohol modified silicone oil and the like.

Examples of the polyether modified silicone oil include silicone oils formed by replacing the main-chain dual-end groups of linear dimethylpolysiloxane with a polyether group, and particularly, the polyether modified silicone oils expressed by the following structural formula (I) are preferred.

[Formula 1]

(I)

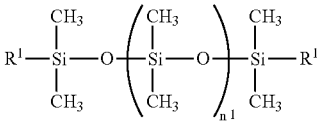

In the structural formula (I), $R^1$ represents $—R^2(C_2H_4O)_a(C_3H_6O)_bH$ (in the formula, "$R^2$" represents an alkyl group having 1 to 5 carbon atoms, "a" represents an integer of 1 to 20, and "b" represents an integer of 1 to 20). "$n^1$" represents an integer of 10 to 60.

The polyether modified silicone oils expressed by the structural formula described above can be produced by a known method.

As a polyether modified silicone oil having a viscosity of 50 to 500 $mm^2/s$ at 25° C., X-22-4274, X-22-4952, X-22-6266 (all produced by Shin-Etsu Chemical Co., Ltd.), and SF 8427, BY 16-004 (all produced by Dow Corning Toray Co., Ltd.) are available as a commercially available article.

Further, examples of the phenol modified silicone oil include silicone oils formed by replacing the main-chain dual-end groups of linear dimethylpolysiloxane, a kind of silicone oil, with a phenol group. Particularly, the modified silicone oils expressed by the following structural formula (II) are preferred.

[Formula 2]

(II)

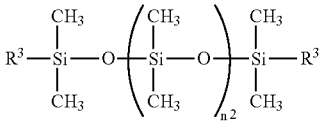

In the structural formula (II), "$R^3$" is a phenol alkyl group expressed by the following formula:

[Formula 3]

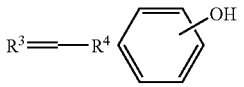

wherein "$R^4$" represents an alkylene group having 1 to 5 carbon atoms, an OH group may be any position of o-, m-, and p-, and "$n^2$" represents an integer of 10 to 60.

The phenol modified silicone oils expressed by the structural formula described above can be produced by a known method.

As a phenol modified silicone oil having a viscosity of 50 to 500 $mm^2/s$ at 25° C., X-22-1821 (produced by Shin-Etsu Chemical Co., Ltd.), and BY 16 799 (produced by Dow Corning Toray Co., Ltd.) are available as a commercially available article.

Further, examples of the alcohol modified silicone oil include silicone oils formed by replacing the single-end group of linear dimethylpolysiloxane, a kind of silicone oil, with an OH group, and the alcohol modified silicone oils having such a structure can also be produced by a known method.

As an alcohol modified silicone oil having a viscosity of 50 to 500 $mm^2/s$ at 25° C., X-22-170DX, X-22-176DX (all produced by Shin-Etsu Chemical Co., Ltd.) are available as a commercially available article.

The lubricant in the present invention is not limited to lubricants shown by the trade name and compounds having a structure of the formula, exemplified in the description of the above-mentioned polyether modified silicone oil, phenol modified silicone oil and alcohol modified silicone oil, and modified silicone oils can be used as a lubricant to improve particularly a feeding property at low temperature as long as the modified silicone oil has each modified groups at the main-chain single-end or the main-chain dual-end and satisfies the condition of having a viscosity of 50 to 500 $mm^2/s$ at 25° C.

Further, as for the modified group in the lubricant (3), not only a polyether group, a phenol group, and a hydroxyl group but also different kinds of modified group such as an amino group, a carboxyl group and a carbinol group may be employed.

The receiving layer in the present invention may be formed by applying and drying a coating solution further having one species or two or more species of silicone oils having a viscosity of out of the above range as a release agent (2) as long as the coating solution comprising the lubricant (3) of a main-chain single-end or a main-chain dual-end modified silicone oil having a viscosity of 50 to 500 $mm^2/s$ at 25° C. in an amount 0.05 to 5 parts by weight with respect to 100 parts by weight of the binder resin (1).

In the present invention, the main-chain single-end or main-chain dual-end modified silicone oil having a viscosity of 50 to 500 $mm^2/s$ serves a function of a lubricant, and the silicone oils having a viscosity of out of the above range all serves a function of a release agent.

As the silicone oil used as a release agent (2), for example, the concurrent use of a side-chain epoxy modified silicone oil, a side-chain amino/polyether modified silicone oil or the like is possible.

When the side-chain epoxy modified silicone oil such as X-22-3000T (produced by Shin-Etsu Chemical Co., Ltd.) and the like as a modified silicone oil is used as the release agent (2), a releasing property from a thermal transfer sheet during thermal transfer can be improved.

As the release agent (2), a silicone oil having reactivity with both the lubricant (3) of a main-chain single-end or a main-chain dual-end modified silicone oil having a viscosity of 50 to 500 $mm^2/s$ at 25° C. and the silicone oil as a release agent (2), described above, is preferably used.

By adding the release agent (2) and the curing agent, it is possible to cure and fix the modified silicone oil added as the lubricant (3) and to prevent the modified silicone oil from transferring from the surface of the receiving layer to the face in contact with the receiving layer.

As described above, the receiving layer comprises the binder resin, the lubricant, and the release agent, and the curing agent and the catalyst can be added, and in addition, various additives can be added as required. Pigments or fillers such as titanium oxide, zinc oxide, kaolin, clay, calcium carbonate, powdered silica can be added for the purpose of improving the whiteness of the receiving layer and further enhancing the sharpness of the transferred images. Further, a publicly known additive such as a plasticizer, an ultraviolet absorber, a light stabilizer, an antioxidant, a fluorescent brightener and an antistatic agent can be added to the receiving layer as required.

The receiving layer can be formed by adding arbitrarily the binder resin (1) described above, the lubricant (3) described above, the release agent (2), and an additive as required, kneading the resulting mixture adequately using a solvent or a diluent to prepare a coating solution for a receiving layer, applying this coating solution onto the substrate sheet described above by a forming means such as a gravure printing method, a screen printing method and a reverse roll printing method which uses a gravure, and drying the coating solution. Coating of an intermediate layer, a backside layer, and an easy-adhesive layer, described later, is performed by the same procedure as in means for forming the receiving layer, described above.

In the thermal transfer image-receiving sheet of the present invention, an amount of the receiving layer to be coated is preferably 0.5 to 4.0 $g/m^2$ on a dry basis. When the amount of the receiving layer to be coated is less than 0.5 $g/m^2$ on a dry basis, unevenness is produced in fixing the dye, and therefore a dye-receiving property may be deteriorated, and when the amount of the receiving layer to be coated is too large, a raw material is futile and a required drying time becomes long, and productivity may be deteriorated.

In the thermal transfer image-receiving sheet of the present invention, layers such as an antistatic layer, a cushion layer, an intermediate layer to which a white pigment and a fluorescent brightener are added and a easy-adhesive layer may be formed between the substrate sheet and the receiving layer as required. Further, layers such as an antistatic layer, a writing layer and a backside layer may be formed on the side opposite to the side of the substrate sheet on which the receiving layer is formed. Particularly, since it is aimed at preventing feeding troubles such as multi feeding in a thermal transfer printer in a low temperature environment in the present invention and the thermal transfer image-receiving sheet is fed with the backside of the thermal transfer image-receiving sheet in contact with the receiving layer, it is preferred to further prevent the feeding troubles by providing the backside layer.

(Backside Layer)

In the thermal transfer image-receiving sheet of the present invention, the backside layer 4 can be provided on the side opposite to the side of the substrate sheet on which the receiving layer is provided in order to improve a feeding property and prevent curling. As a backside layer having such a function, a backside layer formed by mixing an organic filler such as nylon filler, acrylic filler, polyamide filler, fluorine filler, polyethylene wax, amino acid powder or the like, or an inorganic filler such as silicon dioxide, metal oxide or the like as an additive in resins such as an acrylic resin, a cellulose resin, a polycarbonate resin, a polyvinyl acetal resin, a polyvinyl alcohol resin, a polyvinyl butyral resin, a polyamide resin, a polystyrene resin, polyester resin, halogenated polymer or the like can be used. In addition, as the backside layer, a layer formed by curing the resins described above with a curing agent such as an isocyanate compound or a chelate compound can also be used.

It is preferred because of good feeding property in the thermal transfer printer in a low temperature environment to use particularly amino acid powder among the additives described above.

The amino acid powder refers to powder having the following chemical structural formula (III):

[Formula 4]

$$RCONH(CH_2)_4CHCOO^-\underset{NH_3^+}{|} \quad \text{(III)}$$

obtained from L-lysine and long-chain alkyl acid, wherein R represents a straight-chain alkyl group having 11 to 17 carbon atoms.

Preferred amino acid powder is powder in the form of flat plate consisting of N-ϵ-lauroyl-L-lysine having the following chemical structural formula (IV):

[Formula 5]

$$C_{11}H_{23}CONH(CH_2)_4CHCOO^-\underset{NH_3^+}{|} \quad \text{(IV)}$$

The amino acid powder is obtained by heating alkyl acid salt of lysine obtained from long-chain alkyl acid and L-lysine in a nonpolar solvent such as liquid paraffin and xylene. Further, N-ϵ-lauroyl-L-lysine powder is available from Ajinomoto Takara Corporation, Inc. as Amihope LL (trade name).

As the amino acid powder, powder having an average particle diameter of 10 to 20 μm is preferably used.

The amino acid powder exists in the backside layer generally in a state of being dispersed in a binder resin.

The amino acid powder is preferably used in an amount 25 to 200% by weight, preferably 50 to 150% by weight, with respect to the binder resin. When the amount of amino acid powder is too large, a film forming property or adhesion may become insufficient, and when it is too small, there may be cases where a desired coefficient of friction cannot be attained.

An amount of the backside layer to be coated is preferably 0.5 $g/m^2$ to 5 $g/m^2$ on a dry basis.

EXAMPLE

Next, the present invention will be described in more detail by way of Examples and Comparative Examples. In addition, "part(s)" or "%" refers to "part(s) by weight" or "% by weight" in Examples and Comparative Examples, unless otherwise specified.

Example 1

As a substrate sheet, a substrate formed by bonding a white polyethylene terephthalate [PET] film with a thickness of 50 μm (Lumirror E63S produced by Toray Industries, Inc.) to two sides of a coated paper (OK Topkote produced by Oji Paper Co., Ltd.; 127.9 g/m$^2$) with a urethane adhesive (TAKELAC A-969V/TAKENATE A-5 (produced by MITSUI TAKEDA CHEMICALS, INC.)=3/1, an amount of the adhesive to be applied: 4 g/m$^2$ (after drying)) was used.

A coating solution for a dye receiving layer having the following composition was applied onto one side of the substrate sheet with a bar coater in such a way that an amount of the coating solution to be applied is 3.0 g/m$^2$ (after drying) and dried at 130° C. for 1 minute to prepare a thermal transfer image-receiving sheet.

Further, a coating solution for a backside layer having the following composition was applied onto the side opposite to the side of the bonded substrate sheet described above, on which the receiving layer has been provided, with a bar coater in such a way that an amount of the coating solution to be applied is 2.0 g/m$^2$ (after drying) and dried at 110° C. for 1 minute to prepare a backside layer.

<Composition of the Coating Solution for a Dye Receiving Layer in Example 1> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts main-chain single-end alcohol modified silicone [X-22-176DX produced by Shin-Etsu Chemical Co., Ltd.] 0.75 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts <Composition of the Coating Solution for a Backside Layer> polyvinyl butyral resin [3000-1 produced by DENKI KAGAKU KOGYO KABUSHIKI KAISHA] 10 parts amino acid powder [Amihope LL produce by AJINOMOTO Co., Inc.] 10 parts solvent (isopropyl alcohol/toluene, weight ratio 1:1) 180 parts Example 2

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 2> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts main-chain single-end alcohol modified silicone [X-22-176DX produced by Shin-Etsu Chemical Co., Ltd.] 0.45 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts Example 3

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 3> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts main-chain single-end alcohol modified silicone [X-22-176DX produced by Shin-Etsu Chemical Co., Ltd.] 0.15 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts Example 4

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 4> polyester resin [VYLON 290 produced by TOYOBO Co., Ltd.] 300 parts side-chain amino group/polyether group modified silicone [X-22-3939A produced by Shin-Etsu Chemical Co., Ltd.]6 parts main-chain single-end alcohol modified silicone [X-22-176DX produced by Shin-Etsu Chemical Co., Ltd.] 0.3 parts isocyanate [TAKENATE A-65 produced by MITSUI TAKEDA CHEMICALS, INC.] 3 parts catalyst [S-CAT52A produced by SANKYO ORGANIC CHEMICALS Co., Ltd.] 1.5 parts Example 5

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 5> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts main-chain dual-end polyether modified silicone [X-22-6266 produced by Shin-Etsu Chemical Co., Ltd.] 0.75 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts Example 6

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 6 vinyl chloride-vinyl acetate copolymer [SOLBIN C produced by Nissin Chemical Industry Co., Ltd.] 150 parts
side-chain epoxy modified silicone [X-22-3000T produced by Shin-Etsu Chemical Co., Ltd.] 7.5 parts
main-chain dual-end alcohol modified silicone [X-22-160AS produced by Shin-Etsu Chemical Co., Ltd.] 0.75 parts
main-chain dual-end phenol modified silicone [X-22-1821 produced by Shin-Etsu Chemical Co., Ltd.] 0.75 parts
isocyanate [TAKENATE A-14 produced by MITSUI TAKEDA CHEMICALS, INC.] 3.75 parts
catalyst [STN-BL produced by SANKYO ORGANIC CHEMICALS Co., Ltd.] 0.025 parts Example 7

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 7> vinyl chloride-vinyl acetate copolymer [SOLBIN C produced by Nissin Chemical Industry Co., Ltd.] 150 parts
side-chain epoxy modified silicone [X-22-3000T produced by Shin-Etsu Chemical Co., Ltd.] 7.5 parts
main-chain dual-end alcohol modified silicone [X-22-160AS produced by Shin-Etsu Chemical Co., Ltd.] 0.75 parts
main-chain single-end alcohol modified silicone [X-22-170DX produced by Shin-Etsu Chemical Co., Ltd.] 0.75 parts
isocyanate [TAKENATE A-14 produced by MITSUI TAKEDA CHEMICALS, INC.] 3.75 parts
catalyst [STN-BL produced by SANKYO ORGANIC CHEMICALS Co., Ltd.] 0.025 parts Example 8

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 8> vinyl chloride-vinyl acetate copolymer [SOLBIN C produced by Nissin Chemical Industry Co., Ltd.] 150 parts
side-chain epoxy modified silicone [X-22-3000T produced by Shin-Etsu Chemical Co., Ltd.] 7.5 parts
main-chain dual-end alcohol modified silicone [X-22-160AS produced by Shin-Etsu Chemical Co., Ltd.] 0.75 parts
main-chain single-end alcohol modified silicone [X-22-176DX produced by Shin-Etsu Chemical Co., Ltd.] 7.5 parts
isocyanate [TAKENATE A-14 produced by MITSUI TAKEDA CHEMICALS, INC.] 3.75 parts
catalyst [STN-BL produced by SANKYO ORGANIC CHEMICALS Co., Ltd.] 0.025 parts Example 9

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 9> vinyl chloride-vinyl acetate copolymer [SOLBIN C produced by Nissin Chemical Industry Co., Ltd.] 150 parts
side-chain epoxy modified silicone [X-22-3000T produced by Shin-Etsu Chemical Co., Ltd.] 7.5 parts
main-chain dual-end alcohol modified silicone [X-22-160AS produced by Shin-Etsu Chemical Co., Ltd.] 1.75 parts
main-chain single-end alcohol modified silicone [X-22-176DX produced by Shin-Etsu Chemical Co., Ltd.] 3.75 parts
isocyanate [TAKENATE A-14 produced by MITSUI TAKEDA CHEMICALS, INC.] 3.75 parts
catalyst [STN-BL produced by SANKYO ORGANIC CHEMICALS Co., Ltd.] 0.025 parts Example 10

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Example 10> vinyl chloride-vinyl acetate copolymer [SOLBIN C produced by Nissin Chemical Industry Co., Ltd.] 150 parts
side-chain epoxy modified silicone [X-22-3000T produced by Shin-Etsu Chemical Co., Ltd.] 7.5 parts
main-chain dual-end alcohol modified silicone [X-22-160AS produced by Shin-Etsu Chemical Co., Ltd.] 2.75 parts
main-chain single-end alcohol modified silicone [X-22-176DX produced by Shin-Etsu Chemical Co., Ltd.] 1.5 parts
isocyanate [TAKENATE A-14 produced by MITSUI TAKEDA CHEMICALS, INC.] 3.75 parts
catalyst [STN-BL produced by SANKYO ORGANIC CHEMICALS Co., Ltd.] 0.025 parts Comparative Example 1

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Comparative Example 1> vinyl chloride-vinyl acetate copolymer [SOLBIN C produced by Nissin Chemical Industry Co., Ltd.] 150 parts
side-chain epoxy modified silicone [X-22-3000T produced by Shin-Etsu Chemical Co., Ltd.] 7.5 parts
main-chain dual-end alcohol modified silicone [X-22-160AS produced by Shin-Etsu Chemical Co., Ltd.] 0.75 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts Comparative Example 2

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Comparative Example 2> polyester resin [VYLON 290 produced by TOYOBO Co., Ltd.] 300 parts side-chain amino group/polyether group modified silicone [X-22-3939A produced by Shin-Etsu Chemical Co., Ltd.]6 parts isocyanate [TAKENATE A-65 produced by MITSUI TAKEDA CHEMICALS, INC.] 3 parts catalyst [S-CAT52A produced by SANKYO ORGANIC CHEMICALS Co., Ltd.] 1.5 parts Comparative Example 3

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Comparative Example 3> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts main-chain dual-end amino modified silicone [X-22-1660B-3 produced by Shin-Etsu Chemical Co., Ltd.] 0.75 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts Comparative Example 4

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Comparative Example 4> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts side-chain polyether modified silicone [KF-353 produced by Shin-Etsu Chemical Co., Ltd.] 0.75 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts Comparative Example 5

A thermal transfer image-receiving sheet was prepared by following the same procedure as in Example 1 except for changing the coating solution for a dye receiving layer in the preparation condition of the thermal transfer image-receiving sheet of Example 1 to the following composition.

<Composition of the Coating Solution for a Dye Receiving Layer in Comparative Example 5> vinyl chloride-vinyl acetate copolymer [SOLBIN C produced by Nissin Chemical Industry Co., Ltd.] 150 parts side-chain epoxy modified silicone [X-22-3000T produced by Shin-Etsu Chemical Co., Ltd.] 7.5 parts main-chain dual-end alcohol modified silicone [X-22-160AS produced by Shin-Etsu Chemical Co., Ltd.] 0.75 parts side-chain polyether modified silicone [KF-355A produced by Shin-Etsu Chemical Co., Ltd.] 0.75 parts isocyanate [TAKENATE A-14 produced by MITSUI TAKEDA CHEMICALS, INC.] 3.75 parts catalyst [STN-BL produced by SANKYO ORGANIC CHEMICALS Co., Ltd.] 0.025 parts (Evaluations)

Next, the feeding properties and the releasing properties of the thermal transfer image-receiving sheets of Examples and Comparative Examples were investigated according to the following methods.

<Feeding Property 1>

The prepared thermal transfer image-receiving sheet was cut out into sheets having a size of 101.5 mm×174.5 mm, and ten sheets of this piece were loaded in a printer DIGITAL PHOTO PRINTER DPP-SV55 (manufactured by SONY Corporation), and printing was carried out in an environmental condition of 5° C. The presence or absence of paper feeding error was observed to rate the thermal transfer image-receiving sheet according to the following criteria. By the way, to make the thermal transfer image-receiving sheet and the printer to adapt to the surrounding, they are left for 2 hours in an environmental condition of 5° C. before the operation of the printer. Further, as for a thermal transfer sheet to be used in printing, a genuine sheet of this printer was used.

(Criteria of Rating)

○: No paper feeding error is present x: Paper feeding error is present

The above-mentioned paper feeding error means that though one sheet of the thermal transfer image-receiving sheet is fed in feeding paper under a normal status, two or more sheets of the thermal transfer image-receiving sheets are simultaneously fed to cause faulty printing.

<Feeding Property 2>

The prepared thermal transfer image-receiving sheet was cut out into sheets having a size of 101.5 mm×174.5 mm, and each thermal transfer image-receiving sheet was overlaid on another sheet with one backside in contact with another image-receiving face and preserved in an environment of 60° C. and 30% in relative humidity for 24 hours with a load of 20 kgf per A6 size being applied. After preservation, these sheets were left standing at room temperature for 3 or more hours, and then left standing for 2 hours in an environmental condition of 5° C., and ten sheets of this piece were loaded in a printer DIGITAL PHOTO PRINTER DPP-SV55 (manufactured by SONY Corporation), and printing was carried out in an environmental condition of 5° C. The presence or absence of paper feeding error was observed to rate the thermal transfer image-receiving sheet in the same manner as the above-mentioned feeding property 1. Further, as for a thermal transfer sheet to be used in printing, a genuine sheet of this printer was used.

<Releasing Property>

The prepared thermal transfer image-receiving sheet was cut out into sheets having a size of 101.5 mm×174.5 mm, and ten sheets of this piece were loaded in a printer DIGITAL PHOTO PRINTER DPP-SV55 (manufactured by SONY Corporation), and printing in black solid was carried out in an environmental condition of 25° C. The presence or absence of paper feeding error was observed to rate the thermal transfer image-receiving sheet according to the following criteria. By the way, to make the thermal transfer image-receiving sheet and the printer to adapt to the surrounding, they are left for 2 hours in an environmental condition of 25° C. before the operation of the printer. Further, as for a thermal transfer sheet to be used in printing, a genuine sheet of this printer was used.

(Criteria of Rating)

○: No problem

Δ: Solid printing of three color print can be performed, but abnormal transfer occurred.

x: Abnormal transfer occurred in almost sheet.

The results of the evaluations are shown in Table 2 below. Further, trade names, modified types (location of a modified group, kinds of modification), viscosity at 25° C. and content (parts by weight) of each modified silicone oil with respect to 100 parts by weight of a binder resin, that is Silicone content (%), of the release agents used in the receiving layer of the thermal transfer image-receiving sheet of Examples and Comparative Example are shown in Table 1.

TABLE 1

| | Silicone trade name used | Modified type | Viscosity ($mm^2/s$) | Silicone content (%) |
|---|---|---|---|---|
| Example 1 | X-22-176DX | Main-chain single-end alcohol modified | 130 | 0.5 |
| | X-22-3000T | Side-chain epoxy modified | | 5.0 |
| | X-22-160AS | Main-chain dual-end alcohol modified | 35 | 0.5 |
| Example 2 | X-22-176DX | Main-chain single-end alcohol modified | 130 | 0.3 |
| | X-22-3000T | Side-chain epoxy modified | | 5.0 |
| | X-22-160AS | Main-chain dual-end alcohol modified | 35 | 0.5 |
| Example 3 | X-22-176DX | Main-chain single-end alcohol modified | 130 | 0.1 |
| | X-22-3000T | Side-chain epoxy modified | | 5.0 |
| | X-22-160AS | Main-chain dual-end alcohol modified | 35 | 0.5 |
| Example 4 | X-22-176DX | Main-chain single-end alcohol modified | 130 | 0.1 |
| | X-22-3939A | Side-chain amino/polyether modified | 3300 | 2.0 |
| Example 5 | X-22-6266 | Main-chain dual-end polyether modified | 420 | 0.5 |
| | X-22-3000T | Side-chain epoxy modified | | 5.0 |
| | X-22-160AS | Main-chain dual-end alcohol modified | 35 | 0.5 |
| Example 6 | X-22-1821 | Main-chain dual-end phenol modified | 100 | 0.5 |
| | X-22-3000T | Side-chain epoxy modified | | 5.0 |
| | X-22-160AS | Main-chain dual-end alcohol modified | 35 | 0.5 |
| Example 7 | X-22-170DX | Main-chain single-end alcohol modified | 70 | 0.5 |
| | X-22-3000T | Side-chain epoxy modified | | 5.0 |
| | X-22-160AS | Main-chain dual-end alcohol modified | 35 | 0.5 |
| Example 8 | X-22-176DX | Main-chain single-end alcohol modified | 130 | 5.0 |
| | X-22-3000T | Side-chain epoxy modified | | 5.0 |
| | X-22-160AS | Main-chain dual-end alcohol modified | 35 | 0.5 |
| Example 9 | X-22-176DX | Main-chain single-end alcohol modified | 130 | 2.5 |
| | X-22-3000T | Side-chain epoxy modified | | 5.0 |
| | X-22-160AS | Main-chain dual-end alcohol modified | 35 | 1.2 |
| Example 10 | X-22-176DX | Main-chain single-end alcohol modified | 130 | 1.0 |
| | X-22-3000T | Side-chain epoxy modified | | 5.0 |
| | X-22-160AS | Main-chain dual-end alcohol modified | 35 | 1.8 |
| Comparative | X-22-3000T | Side-chain epoxy modified | | 5.0 |
| Example 1 | X-22-160AS | Main-chain dual-end alcohol modified | 35 | 0.5 |
| Comparative Example 2 | X-22-3939A | Side-chain amino/polyether modified | 3300 | 2.0 |
| Comparative | X-22-1660B-3 | Main-chain dual-end amino modified | 550 | 0.5 |
| Example 3 | X-22-3000T | Side-chain epoxy modified | | 5.0 |
| | X-22-160AS | Main-chain dual-end alcohol modified | 35 | 0.5 |
| Comparative | KF-353 | Side-chain polyether modified | 400 | 0.5 |
| Example 4 | X-22-3000T | Side-chain epoxy modified | | 5.0 |
| | X-22-160AS | Main-chain dual-end alcohol modified | 35 | 0.5 |
| Comparative | KF-355A | Side-chain polyether modified | 140 | 0.5 |
| Example 5 | X-22-3000T | Side-chain epoxy modified | | 5.0 |
| | X-22-160AS | Main-chain dual-end alcohol modified | 35 | 0.5 |

TABLE 2

| | Feeding property 1 | Feeding property 2 | Releasing property |
|---|---|---|---|
| Example 1 | ○ | ○ | ○ |
| Example 2 | ○ | ○ | ○ |
| Example 3 | ○ | ○ | ○ |
| Example 4 | ○ | ○ | ○ |
| Example 5 | ○ | ○ | ○ |
| Example 6 | ○ | ○ | ○ |
| Example 7 | ○ | ○ | ○ |
| Example 8 | ○ | ○ | ○ |
| Example 9 | ○ | ○ | ○ |
| Example 10 | ○ | ○ | ○ |

TABLE 2-continued

| | Feeding property 1 | Feeding property 2 | Releasing property |
|---|---|---|---|
| Comparative Example 1 | X | X | ○ |
| Comparative Example 2 | X | X | ○ |
| Comparative Example 3 | X | X | ○ |
| Comparative Example 4 | X | X | ○ |
| Comparative Example 5 | X | X | ○ |

EXPLANATION OF SYMBOLS

Figure 1:
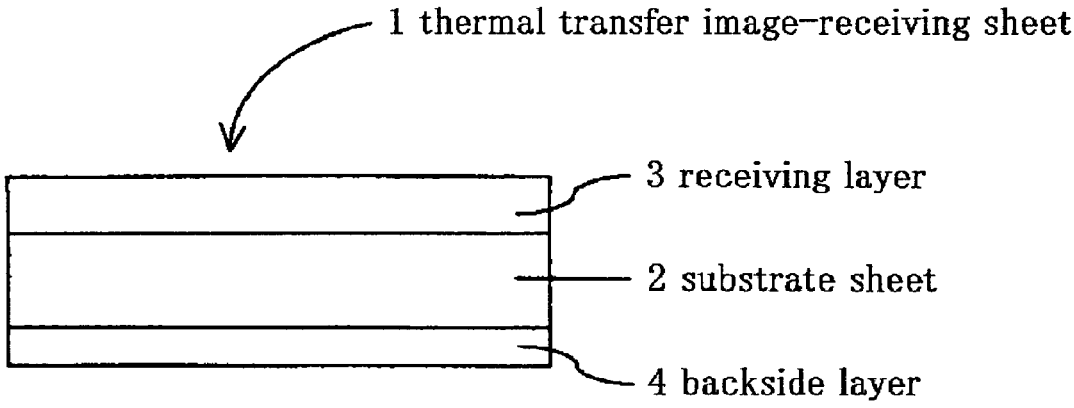
FIG. 1 is a schematic view showing an embodiment of a thermal transfer image-receiving sheet of the present invention.

1 thermal transfer image-receiving sheet
2 substrate sheet
3 receiving layer
4 backside layer

The invention claimed is:

1. A thermal transfer image-receiving sheet in which a receiving layer is formed on at least one side of a substrate sheet, wherein the receiving layer is formed by applying and drying a coating solution comprising a binder resin, a release agent, and a lubricant in an amount of 0.05 to 5 parts by weight with respect to 100 parts by weight of the binder resin and said lubricant is a main-chain single-end or a main-chain dual-end modified silicone oil having a viscosity of 50 to 500 $mm^2/s$ at 25° C.

2. The thermal transfer image-receiving sheet according to claim 1, wherein said release agent comprises a side-chain epoxy modified silicone oil.

3. The thermal transfer image-receiving sheet according to claim 2, wherein said receiving layer further comprises a curing agent.

4. The thermal transfer image-receiving sheet according to claim 1, wherein said receiving layer further comprises a curing agent.

* * * * *